United States Patent [19]

Rittenbaum et al.

[11] 4,099,288

[45] Jul. 11, 1978

[54] DUST MITT WITH OPTIONAL HANDLE

[75] Inventors: Max Rittenbaum, Atlanta; Jeffrey A. Rittenbaum, Marietta, both of Ga.

[73] Assignee: Max Rittenbaum, Inc., Atlanta, Ga.

[21] Appl. No.: 784,805

[22] Filed: Apr. 5, 1977

[51] Int. Cl.[2] ..... A47L 13/16; A47L 13/20

[52] U.S. Cl. ..... 15/228; 15/145

[58] Field of Search ..... 15/147 R, 147 A, 227, 15/228, 229 AP, 229 AC, 229 BP, 244 R, 145; 128/269; 401/203-205, 207

[56] References Cited

U.S. PATENT DOCUMENTS

| | | | |
|---|---|---|---|
| 815,343 | 3/1906 | Garnet | 15/228 |
| 1,688,374 | 10/1928 | Belfry | 15/227 |
| 2,816,313 | 12/1957 | Beck et al. | 15/228 X |
| 2,846,708 | 8/1958 | Vosbikian et al. | 15/227 X |
| 3,716,885 | 2/1973 | Thompson | 15/244 R X |
| 3,945,736 | 3/1976 | Rittenbaum et al. | 15/229 AP X |

*Primary Examiner*—Daniel Blum
*Attorney, Agent, or Firm*—Patrick F. Henry

[57] ABSTRACT

A dust mitt comprising a dust mitt cover made of a nappy or pile material into a pocket formation by folding the material inwardly along the sides to form edges and then folding the material upon itself to form the pocket with an open end into which is inserted a folded section of soft, resilient and absorbent foam plastic material of sufficient bulk and thickness to fill the inside of the pocket. The open end of the pocket is closed into a small fabric mouth which optionally receives one end of a stick handle inserted inside the folded foam material.

4 Claims, 4 Drawing Figures

DUST MITT WITH OPTIONAL HANDLE

BACKGROUND OF THE INVENTION

1. Field of the Invention

Cleaning implements and especially mops, dust mitts, absorbent pads and the like.

2. Description of the Prior Art

The prior art includes numerous dust mops and similar dust mitt devices. For example, it is quite common to make a dust mitt in the form of a glove into which the hand is inserted. Such devices are very useful and practical for the purpose but among other things do not include any means such as a handle for reaching into remote places. Furthermore, there is no way a handle or extension can be attached to or inserted in that type of dust mitt without a great deal of revision. There are also wet and dry dust mops and similar devices, such as that shown in our prior U.S. Pat. No. 3,945,736 wherein handle extensions are attached inside of the devices. These are intended more elaborate arrangements for heavy duty car washing and optional dusting and are more involved and complicated than necessary for simple dusting jobs. The present device provides a simple and inexpensive dust mitt arrangement which is capable of receiving a removable, optional handle that is held in place by a very uncomplicated arrangement of tightly stuffing foam material in a pocket and inserting the handle therein.

SUMMARY OF THE INVENTION

A dust mitt having an optional handle and comprising a nappy or pile fabric pocket in which is tightly stuffed and inserted resilient and soft foam material, such as foam plastic, which has a tightly compressed space therein receiving a removable handle through the end of the pocket.

DESCRIPTION OF THE PREFERRED EMBODIMENT

Figure 1:
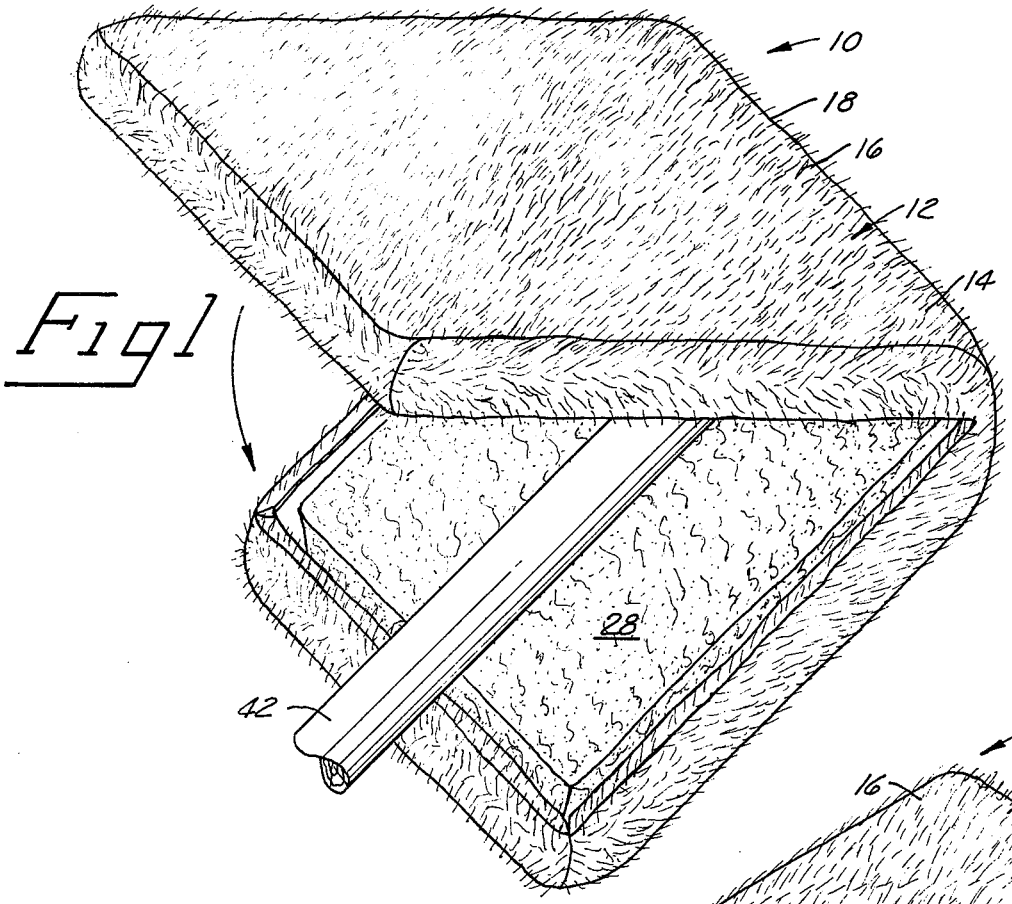
FIG. 1 is a perspective view of the present device partly opened and disassembled to show certain internal details.
Figure 4:
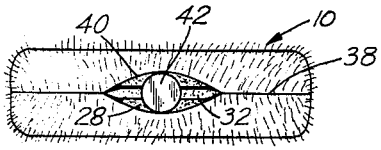
FIG. 4 is a front view of the assembled device.
Figure 2:
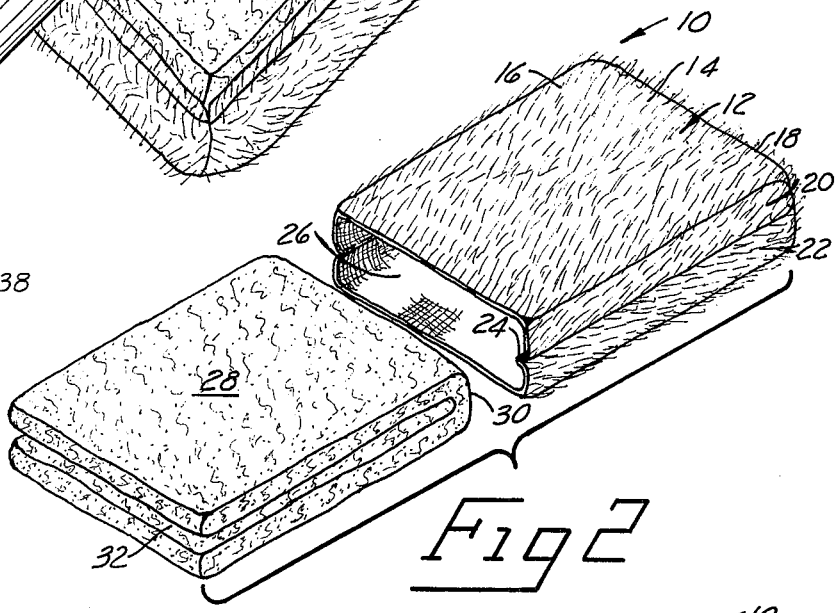
FIG. 2 is a perspective assembly view of the present arrangement showing one way of constructing and assembling the device.
Figure 3:
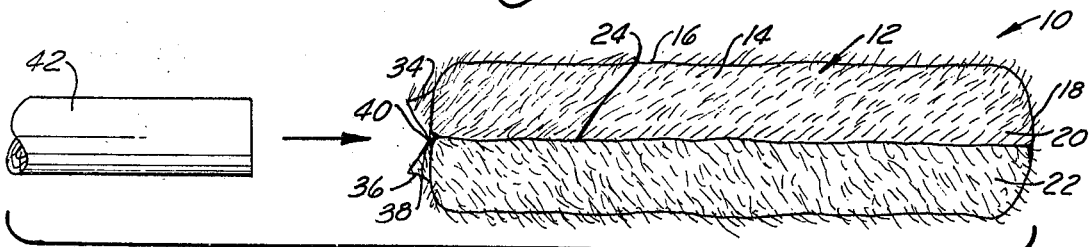
FIG. 3 is a side elevation view of the present device showing the insertion of the optional handle.

The completed and assembled device is designated by reference numeral 10 and comprises an outer cover 12 made from a nappy or pile fabric 14 having nap or pile 16 thereon. As seen in FIG. 2, the mitt 10 has a pocket 12 therein constructed by folding the fabric 14 lengthwise upon itself one time after turning side edges 20, 22 downwardly and upwardly on both sides to create an overlapping seam 24 which is stitched, glued or otherwise secured in place, which leaves a front opening 26 into the pocket 12 and into which is inserted the inner stuffing or filler comprising a section of elongated foam plastic of planar formation and having sufficient thickness so that when folded upon itself in the manner shown in FIG. 2 forms an inner smooth curved end 30 on one end and an open slot 32 on the other end. As seen in FIGS. 1 and 3, after the filler 28 is inserted in place a portion of the front of the pocket 12 along the top edge 34 and bottom edge 36 is folded downwardly and upwardly respectively to form a front marginal seam 38 which leaves a small puckered opening 40 into which may be inserted the end of a stick handle 42 which is forced between the compressed stuffing and filler 28 all the way into the interior thereof in the manner shown in FIG. 1.

Of course, in lieu of the assembly and construction form shown in FIG. 2 it is possible to construct the pocket 12 as an open cavity and in the manner shown in FIG. 1 to place the filler 28 therein and fold the entire assembly along the back marginal edge 18, thereafter gluing the side seams 24 and front seams 38 or otherwise attaching same in place still leaving a small opening 40 to insert and remove the handle 42. Therefore, it is not necessary to assemble the device in the manner shown in FIG. 2 by first making the open pocket prior to inserting the stuffing 28.

While I have shown and described a particular embodiment of this invention together with various suggested mode of construction and assembly this is by way of description of a preferred embodiment only and does not constititue any sort of limitation on the scope of the invention because various alterations, changes, deviations, eliminations, substitutions, additions, revisions and departures may be made in the embodiment shown without avoiding the scope of the invention as defined only by a proper interpretation of the appended claims.

What is claimed:

1. In a dust mitt having an optional handle:

a mitt constructed from a nappy fabric in three-dimensional form and having a three-dimensional space in the interior thereof defining a pocket therein, said pocket having a closed front except for a small opening to the interior, a stuffing inside said pocket in the three-dimensional space therein comprising a sheet of elongated soft, resilient foam material, such as foam plastic, folded substantially in half upon itself to create a smooth marginal edge at one end and an open space aligned with the opening at the other end leading to the interior thereof, an elongated handle inserted through said opening into and between portions of said frictionally held folded resilient foam material and being removable therefrom, and a small puckered mouth leading to said opening.

2. The device in claim 1 wherein said resilient foam material is tightly packed in said pocket so that said handle is tightly captured therein but is removable therefrom simply by sliding same therefrom out of said opening.

3. The device in claim 1 wherein said mitt is constructed by folding same to form side marginal edges that are stitched together.

4. The device in claim 3 wherein said mitt is folded from an elongated sheet folded upon itself one time.

* * * * *